United States Patent [19]

Northrup

[11] Patent Number: 4,533,854

[45] Date of Patent: Aug. 6, 1985

[54] MECHANISM AND METHOD FOR CONTROLLING THE TEMPERATURE AND OUTPUT OF A FLUORESCENT LAMP

[75] Inventor: Karl A. Northrup, Rochester, N.Y.

[73] Assignee: Xerox Corporation, Stamford, Conn.

[21] Appl. No.: 478,746

[22] Filed: Mar. 25, 1983

[51] Int. Cl.[3] ..... H01J 7/24; H01J 13/32; H01J 19/74; H01J 61/52

[52] U.S. Cl. ..... 315/117; 315/115; 315/116; 315/151; 315/158; 250/205

[58] Field of Search ..... 315/112, 113, 114, 115, 315/116, 117, 149, 150, 158; 250/205

[56] References Cited

U.S. PATENT DOCUMENTS

| | | | |
|---|---|---|---|
| 3,786,308 | 1/1974 | Browner et al. | 315/248 |
| 4,005,332 | 1/1977 | Gallo et al. | 315/112 |
| 4,016,450 | 5/1977 | Balekjian | 315/149 |
| 4,032,817 | 6/1977 | Richmond | 315/149 |
| 4,146,819 | 3/1979 | Hunter | 315/117 |
| 4,283,658 | 8/1981 | Parker | 315/117 |
| 4,431,947 | 2/1984 | Ferriss et al. | 315/117 |

*Primary Examiner*—Saxfield Chatmon

[57] ABSTRACT

The light output of a fluorescent lamp is controlled and optimized. The light output of a lamp peaks at some optimum value of mercury cold spot temperature. During operation the lamp output is continually monitored, any drop in peak light output is detected, and a signal is generated which reverses the instant mode of operation of a cooling device placed in proximity to the lamp cold spot. With the cooling mode reversed, the light output will rise towards the peak. The cooling mode remains unaltered until the light output falls again.

4 Claims, 3 Drawing Figures

MECHANISM AND METHOD FOR CONTROLLING THE TEMPERATURE AND OUTPUT OF A FLUORESCENT LAMP

BACKGROUND

This invention relates to mercury vapor fluorescent lamps and particularly to a method for maintaining the mercury pressure within the lamp at an optimum value of monitoring and controlling the actinic output of the lamp.

In a mecury fluorescent lamp, an electrical discharge is generated in a mixture of mecury vapor at low pressure and a fill gas typically argon, neon, Krypton, xenon or mixtures thereof. The light output from the lamp depends, among other variables, on the mercury vapor pressure inside the lamp tube. The primary radiation from the mercury is at 2537 Angstroms and arises from the transition between the lowest non-metastable excited state and the ground state. This ultraviolet radiation at 2537 Angstroms excites a phosphor which is coated inside the tube walls. The excited phosphor thereupon emits radiation at some wavelength, in the visible spectrum, characteristic of the phosphor.

It is known in the prior art that the optimum mercury pressure for maximum light output of a fluorescent lamp approximately 7 mtorr (independent of current) which corresponds to a mercury cold spot temperature of approximately 40° C. ($\approx$100° F.). At this temperature and pressure, the light output increases monotonically with the current. At cold spot temperatures higher or lower than the optimum, light output falls off.

It is therefore desirable to maintain the mercury pressure at the optimum at any lamp current and at any ambient temperature. Prior art techniques for accomplishing this function required a temperature-sensitive device such as a thermocouple, thermistor or thermostat to monitor the temperature of the cold spot. A feedback circuit provided closed loop control of a temperature-regulating device to maintain the optimum mercury pressure. These methods, although providing a closed loop control of the cold spot temperature sensor, must rely on a consistent relationship of cold spot sensor temperature to light output which may not exist under all conditions.

The present invention is directed to a novel method for maintaining optimum mercury pressure which does not require the use of cold spot temperature measuring devices. As will be demonstrated in the succeeding descriptive portion of the specification, if lamp current is kept constant, as mentioned above, the light output of the lamp (e.g. the phosphor output and, in some cases, the actinic energy made up of the phosphor and some of the mercury line energy) is a function of the mercury cold spot temperature. The optimum cold spot temperature is that which results in a peak or maximum light output. According to one aspect of the invention, the light output is continually monitored by a detector which is adapted to feed back a signal to a cold spot, temperature-regulating device under certain conditions. A control system responds to any reduction in the light output by reversing the operating mode of the temperature-regulating device. Thus, if the device has been off it is turned on and if on, it is turned off. Either action has the effect of restoring the light output to its peak level, and hence restoring the optimum mercury pressure.

A prime advantage of the method of the invention is that the system does not require any absolute calibration; that is, the peak light output for a particular lamp does not need to be determined. The system can sense and maximize the light output and provide constant maximum exposure for any current level. Further, the feedback circuit is extremely fast relative to the prior art feedback loop which required a longer response time due to the thermal mass of the mercury pool heat sink, the glass envelope and the temperature sensitive device.

The present invention is therefore directed to a monitoring and control system for optimizing and controlling the light output of a fluorescent lamp containing an excess of mercury at a cold spot therein, said system comprising:

- a power supply for applying operating current to said lamp,
- temperature control means adapted to operate in a first mode whereby temperature at said cold spot is increasing and in a second mode whereby temperature at said cold spot is decreasing, and
- a monitoring means for detecting a drop in the light output of said lamp, said monitoring means adapted to transmit a signal to said temperature control means changing the instant mode of operation.

DRAWINGS

DESCRIPTION

Figure 1:
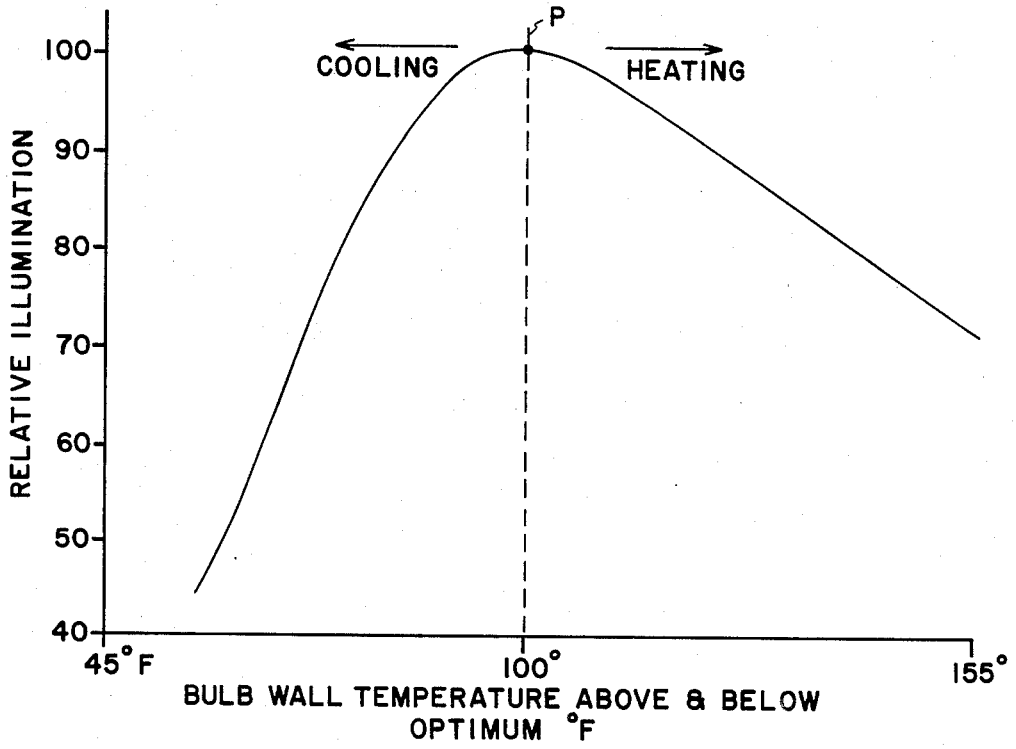
FIG. 1 is a graph plotting fluorescent lamp light output against mercury cold spot temperature.

If the current through a mercury fluorescent lamp is kept constant, the light output is a function of the lamp mercury cold spot temperature. FIG. 1 is a graph illustrating the relation between lamp output and mercury cold spot temperature at constant current. As shown, there is a point P at which the light output is a maximum. Point P corresponds to the optimum mercury pressure at 7 mtorr at a cold spot temperature of approximately 100° F. (40° C.) which in turn corresponds to the maximum operating efficiency of the lamp. The mercury vapor pressure, being dependent upon temperature, will vary above or below the optimum during lamp operation; depending on the temperature variation as affected by the instant mode of operation of the temperature regulating device (i.e. a cooling fan, thermoelectric device or the like). As is evident in FIG. 1, the lamp light output will move away from its peak point P with either a rise or a fall in the cold spot temperature. According to one aspect of the invention the light output is monitored by a detector which detects any change (reduction) in light output. The detector then generates a signal which reverses the operating mode of the particular temperature regulating device resulting in a reversal of the particular direction of the temperature change and a restoral of the optimum pressure, and peak light output. As an example, if a cooling fan is being used to direct a flow of air against the lamp to affect the mercury cold spot temperature, and if the fan is in the inoperative (off) position, the cold spot temperature will tend to rise above the optimum. The light output will then decrease towards the right in the FIG. 1 plot. This decrease will be detected by the detector and a signal will be generated and sent to the fan, via a control circuit, reversing the previous operational mode; that is, the fan will be turned on. The effect of the cooling will tend to decrease the cold spot temperature and return the pressure, and light output to the optimum value. If the system establishes equilibrium at the optimum operating point, the monitoring circuit remains inactive. If however, the temperature again drops below the optimum, the detector again detects a decrease in light output and generates a signal to again reverse operation of the fan. In this case the fan will be turned off, allowing the temperature to rise towards the optimum. It does not matter in which direction the temperature is changing since the output signal to the temperature regulating means will always have the effect of selecting the operating mode appropriate to a restoration of the optimum operating level.

The above described technique is fully enabled by employing some mechanism to differentiate as to the conditions where the light output is below optimum but is moving back towards the optimum (function is improving) as opposed to the condition where the light output is below the optimum and is receding (function not improving). A simple algorithm may be formulated to accomplish this result. Using the example of a fan directing air against the cold spot, if the light output is increasing in magnitude and the fan is off, the algorithm should be able to recognize that the lamp has not yet reached peak temperature and the fan should therefore remain off. The algorithm only responds to decreases in the light output. If however, the light output was decreasing and the fan was off, the alogrithm will recognize that the fan needed to be turned on to lower the temperature. The algorithm might also incorporate time delays that allow the lamp a chance to respond to the new cooling change. An example of a suitable algorithm is provided below.

Figure 2:
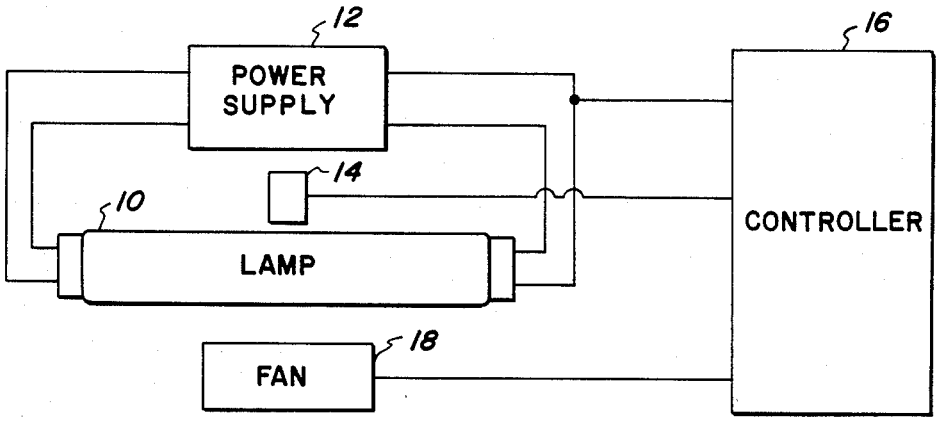
FIG. 2 is a schematic diagram of a circuit including a light output detector and a controller which implement the output control techniques of the present invention.
Figure 3:
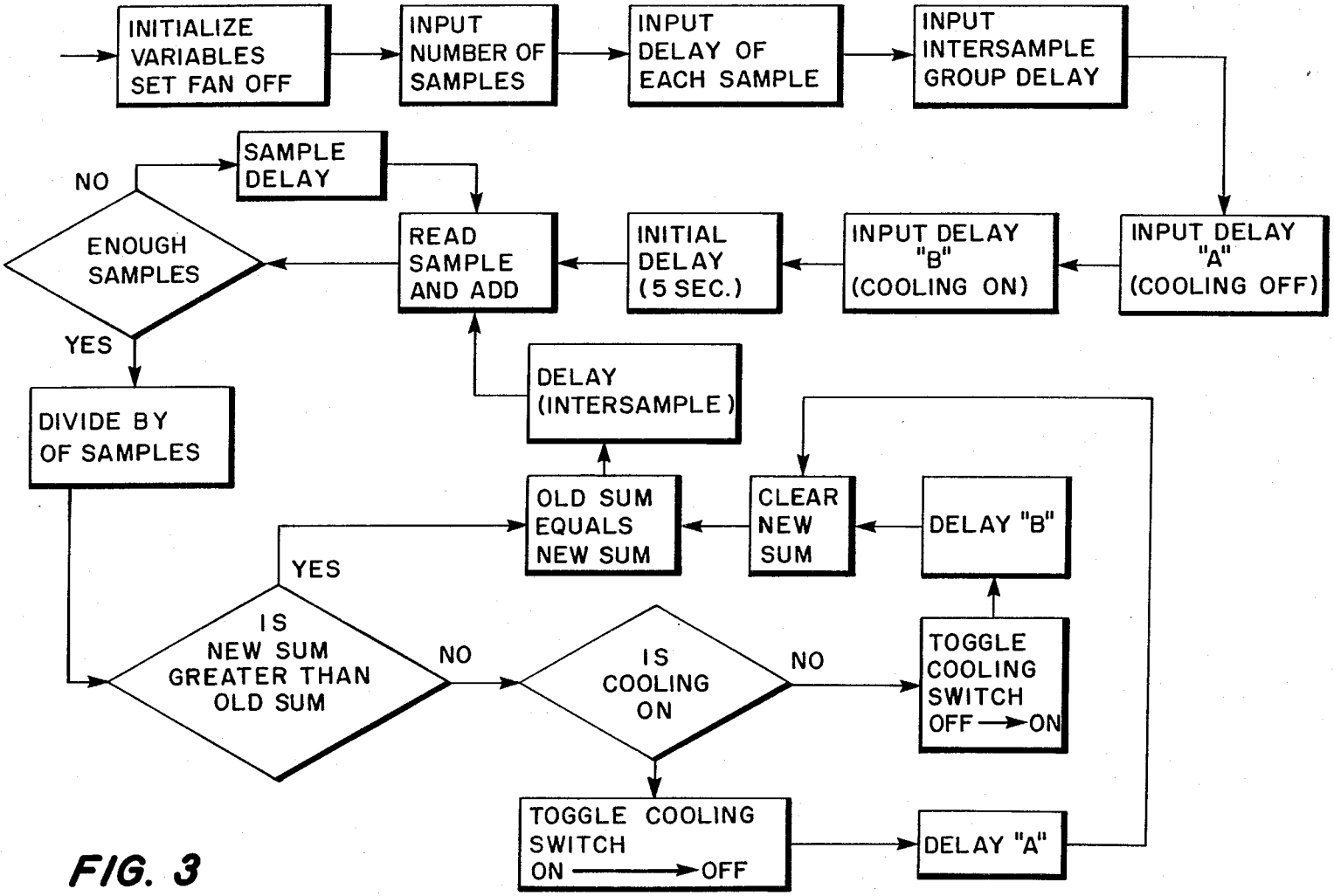
FIG. 3 is a program flow diagram of the controller shown in FIG. 2.

FIG. 2 is a block diagram of a circuit set-up to implement the monitoring technique broadly disclosed in the above discussion. Lamp 10 is a T8, 22" fluorescent lamp operated at 1.2 amps with a high frequency (29 Khz) power supply 12. A photodiode detector 14, monitors the lamp actinic energy and generates a signal sent to controller 16. Fan 18 is placed near the center of the lamp and about 4" away to provide mercury cold spot cooling when it is turned on. Controller 18 is a microprocessor based controller which receives a signal from detector 14. The controller is programmed to control the operation of fan 12 so as to maintain cold spot temperature and pressure at optimum. FIG. 3 is the algorithm flow diagram for this program. As shown in FIG. 3, the algorithm contains the following variables: number of samples, time between individual samples, time between groups of samples average value of a group of samples with the previous averaged group and if a lower light output signal has been detected, changes the cooling mode (on to off or off to on). Further sample taking is then delayed to allow lamp 10 to respond to the change. Two time delays A and B may be necessary for systems where the lamp responded much faster to the application of the cooling airflow then when the airflow is stopped.

The foregoing description of the present invention is given by way of illustration and not of limitation. Various other embodiments may be utilized to perform the monitoring and control functions while still within the purview of the invention. For example, for some systems an RC differentiating circuit may be used in place of controller 16 to determine whether the function is improving or not improving. Also, instead of a cooling fan, a thermoelectric (Peltier's junction) cooler could be used to control the cold spot temperature in response to signals generated in the voltage monitoring circuit.

What is claimed is:

1. A monitoring and control mechanism for optimizing and controlling the light output of a fluorescent lamp containing an excess of mercury at a cold spot therein, said mechanism comprising:

a power supply for applying a constant operating current to said lamp, a monitoring means for detecting a drop in a light output of said lamp and for generating a signal indicative thereof, a temperature control device placed in proximity to said cold spot, said device, when operational, serving to provide a constant intensity output to lower the temperature of the cold spot and, when non-operational, effectively permitting the cold spot temperature to rise, a controller circuit adapted to change the operational state of said temperature control device in response to the output signals from said monitoring means.

2. The mechanism of claim 1 wherein said controller circuit is adapted to analyze the direction of light decrease and to send a signal to said temperature control device so as to reverse its state of operation.

3. The mechanism of claim 1 wherein said monitoring means is a photodetector.

4. A method of optimizing the light output of a fluorescent lamp containing an excess of mercury at a cold spot thereon comprising the steps of:

monitoring the light output of said lamp, modifying the temperature at said cold spot by means of a temperature regulating device having an active mode of operation serving to provide a constant intensity output and an inactive mode of operation, and generating an electrical signal responsive to a dropoff from the optimum light output level, causing the instant mode of operation of said temperature regulating to be changed in response to said energy level.

* * * * *

UNITED STATES PATENT AND TRADEMARK OFFICE

CERTIFICATE OF CORRECTION

PATENT NO. : 4,533,854

DATED : August 6, 1985

INVENTOR(S) : Karl A. Northrup

It is certified that error appears in the above-identified patent and that said Letters Patent are hereby corrected as shown below:

Col. 1, line 12, change "mecury" to --mercury--; line 13 make the same change.

Col. 2, line 27, replace ";" with --.--.

Col. 3, line 53, after samples" insert --and two delay times, one for each mode switch. The algorithm compares the--.

Signed and Sealed this

*Eighth* Day of *July 1986*

[SEAL]

*Attest:*

DONALD J. QUIGG

*Attesting Officer*

*Commissioner of Patents and Trademarks*